United States Patent [19]

Peperstraete et al.

[11] 4,260,239

[45] Apr. 7, 1981

[54] BRUSH TYPE TONER DEPOSITION DEVICE

[75] Inventors: Jan Peperstraete, Oud Heverlee; Walter Breugelmans, Aarschot, both of Belgium

[73] Assignee: Repro S.V., Vilvoorde, Belgium

[21] Appl. No.: 71,715

[22] Filed: Aug. 31, 1979

[30] Foreign Application Priority Data

Sep. 15, 1978 [NL] Netherlands ..... 7804920

[51] Int. Cl.[3] ..... G03G 15/00

[52] U.S. Cl. ..... 355/3 DD; 118/623; 118/657

[58] Field of Search ..... 355/3 DD; 118/623, 624, 118/625, 656, 657; 430/120, 122

[56] References Cited

U.S. PATENT DOCUMENTS 3,962,992 6/1976 Takagi et al. ..... 118/623 X

*Primary Examiner*—R. L. Moses

*Attorney, Agent, or Firm*—John P. Snyder

[57] ABSTRACT

A reproduction device of the electro-static type comprising an image carrier and a toner deposition device of the brush type consisting of a roller and a magnet arranged inside the same wherein the magnet and the roller are arranged so as to be stationary and the magnet is a multi-polar electro-magnet and has a three-phase winding.

6 Claims, 5 Drawing Figures

Figure 2:
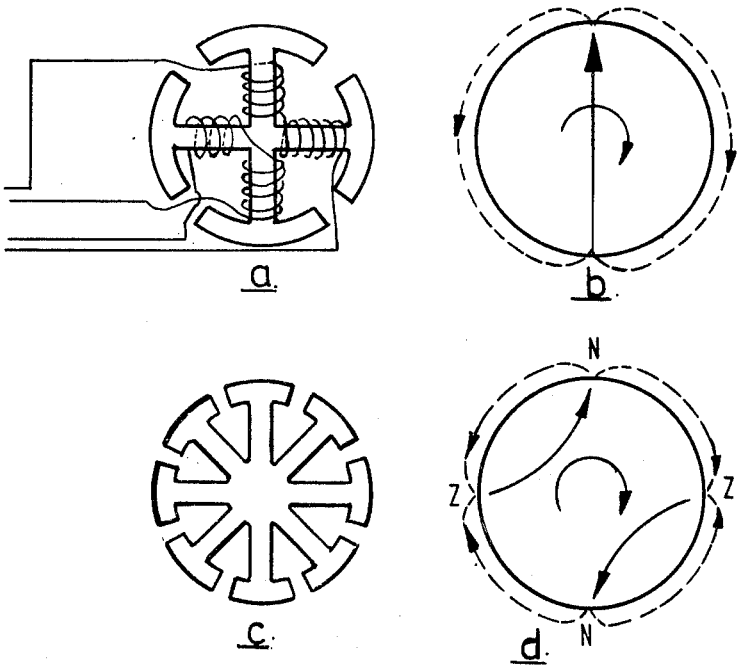

FIG.1
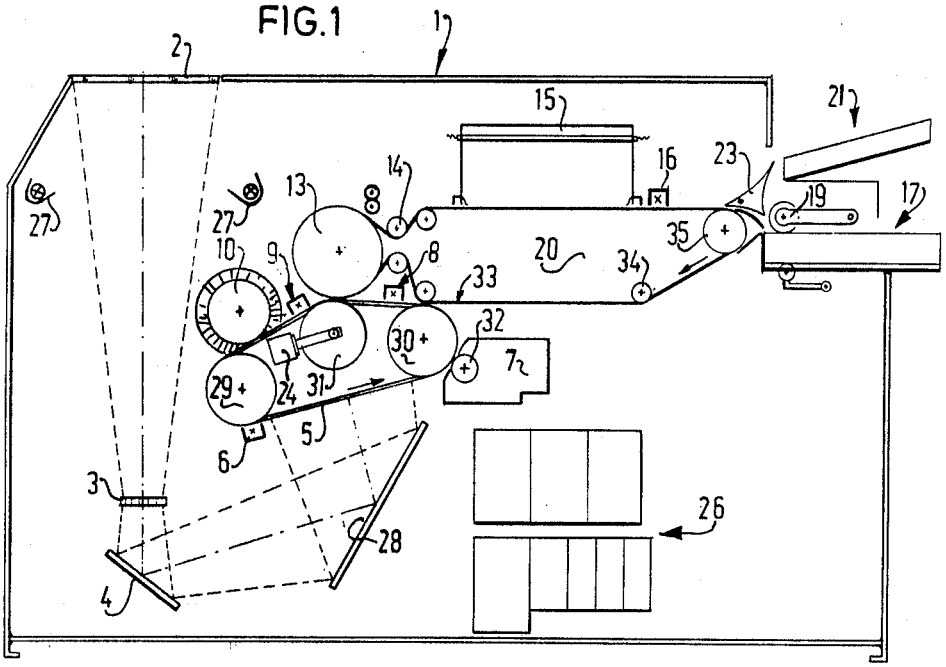
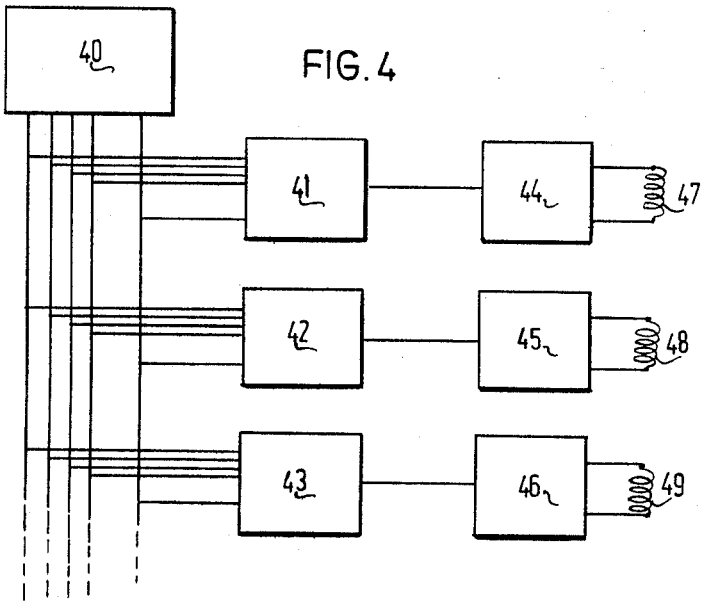
FIG. 4
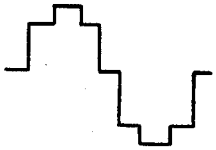
FIG.5

BRUSH TYPE TONER DEPOSITION DEVICE

The invention relates to a reproduction device of the electrostatic type comprising an image carrier and a toner deposition device of the brush type consisting of a roller and a magnet arranged inside thereof. In a generally known reproduction device of the type set forth the toner may be applied in various ways to the image carrier. There is known inter alia the cascade method in which the toner material falls freely along the image carrier. The particles are attracted towards the image carrier by the attractive force of the information carrying parts of the image exerted on the toner material.

A further method is termed the brush-type method. In this method a brush-shaped roller is used for transporting toner material from a reservoir towards the image on the image carrier. In this case a magnet is used for retaining the toner particles on the brush-like roller. This process is distinguished by a method in which the roller rotates out of a position in which toner material is picked up from the reservoir and transported towards a position near the image carrier, where the toner material is released or by a method in which the roller is stationary, whereas the magnet rotates inside the roller for moving the toner material along the roller from the reservoir towards the image carrier. In both cases a permanent magnet is employed.

The prior art toner deposition device of the brush type has various disadvantages. In the first place the amount of toner material to be applied depends upon the transport rate of the roller or the magnet respectively and upon the strength of the magnet. The amount of toner material to be applied per unit time with a selected value of the magnetic field strength can only be varied by varying the speed of rotation either of the magnet or of the roller. A variation of the speed would require a variation of, for example, the transmission mechanism between the driving motor and the roller or the magnet respectively, which is a complicated problem. An increase in strength of the magnetic field of a permanent magnet is subjected to limitations primarily of technical nature of the material.

The present invention has for its object to obviate the aforesaid disadvantages and to provide a deposition device by which the amount of toner material applied per unit time to the image carrier can be readily controlled at will.

According to the invention this is achieved in that the magnet and the roller are arranged so as to be stationary, the magnet is a multi-polar electro-magnet and has a three-phase winding. During the rotation of the magnetic field, the roller and the electro-magnet being stationary, toner material is transferred from a reservoir towards the image carrier. By increasing the frequency of the rotary field and by an increase in strength thereof the amount of toner material applied by unit time can be appreciably raised. This has the advantage that a single disposition device will be sufficient, whereas the reproduction devices hitherto known generally required two or more deposition devices. Moreover, when the distance between the applying roller and the image carrier changes, for example, due to ageing, a slight change of the field strength or of the frequency will compensate for said change. The distance between the image carrier and the roller as well as the quality of the roller are less critical than in the prior art reproduction devices.

The three-phase winding can be fed with a two- or three-phase current. In order to obtain the desired rotary field a digital-signal generator and a summation circuit for the weighted summation of the digital signals may be used, the outputs of the summation device being each connected to a winding of the electro-magnet. The generator may be a digital counter and the summation circuits may be each connected through a filter circuit to the winding of the electro-magnet in order to filter out the higher harmonics so that a substantially sinusoidal current will flow through the windings.

The invention will be described more fully with reference to an embodiment shown in the drawings.

The drawings show in

Figure 3:
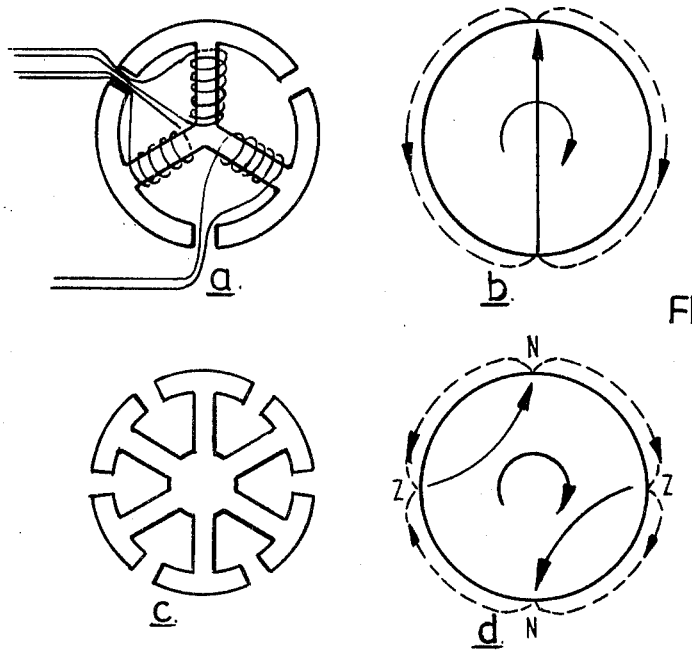

FIG. 1 schematically the construction of a reproduction device of the electro-static type, FIG. 2 schematically a brush with an electro-magnet and a two-phase winding in accordance with the invention, FIG. 3 schematically a brush with an electroc-magnet having a three-phase winding in accordance with the invention, FIG. 4 a block diagram of a control-device for the various windings of the electro-magnet and FIG. 5 the waveform of the electric signals applied to the windings of the electro-magnet.

The reproduction device is arranged in a housing 1. The top side of the housing is provided with an image plate 2 on which an original to be reproduced is deposited with the information carrying face turned downwards. A light source 27 produces a flash exposing the original. The rays reflected by the original are projected through an optical system comprising a lens 3 and mirrors 4 and 28 onto the photo-sensitive tape 5 travelling in the direction of the arrow. The photo-sensitive tape 5 has acquired at the charging station 6 a uniform charge and is discharged by the exposure to the image of the original 2 selectively in accordance with the information carrying parts of the image. The photo-conductor 5 has the shape of an endless, seamless belt passed around the rollers 29, 30 and 31. The roller 31 is connected with a mechanism 24 for positioning and stretching the belt. Subsequent to exposure the image carrying part of the belt arrives at the developing station 7. In the developing station 7 a brush-type deposition device comprising a roller 32 and a magnet arranged therein transfers toner or developing material from a reservoir to the image on the belt 5. The transfer of the toner particles from the roller 32 to the image on the belt 5 results from the higher attractive force exerted by the information carrying parts of the image than the attractive force exerted by the magnet. When leaving the developing station 7 the belt 5 carries a developed image, the information carrying zones of which are occupied by toner material. Subsequently, the photo-sensitive belt 5 comes in the effective range of a conveyor belt 33. The conveyor belt 33 is an endless belt guided by a number of rollers, for example, 14,34 and driven by a roller 35 in the direction of the arrow. To the conveyor belt 33 are fed sheets of paper from the paper store 17 separately by an elevator mechanism 19 from the stack in the store. The sheets are carried along by the conveyor and retained thereon by subatmospheric pressure inside the space 20 bounded by the conveyor. Through perforations in the conveyor belt or, when the conveyor belt is composed of strip-shaped conveyors moving in parallel, through perforations in plates arranged between said strips, a suction effect is obtained on the paper sheets. A sheet supplied by the elevator 33 comes in the transfer station 8 into contact with the developed image on the photo-conductor 5. In the transfer station 8 is prevailing an electric field moving the toner material to the sheet of paper. When the transfer station 8 is left, the toner image is transferred to the paper sheet and is retained thereon. Subsequently the paper sheet is wound around the suction drum 13 and is guided to the fixation station 15. In the fixing station flash lamps transmit radiation energy to the paper sheet so that the toner material mels and adheres to the paper. After the fixation station 15 is left, the sheet is acted upon by a discharging corona device 16, which neutralises residual charge on the sheet. Then the sheet is passed via a guiding device 23 either to the output tray 21 or to the tray 17, if two-sided copying is desired. Subsequently the cycle is repeated.

In the station 9 the residual charge on the photo-conductor 5 is removed by means of a corona device. Subsequently, in the station 10 the belt is cleaned by means of a brush so that it is ready for the next cycle.

The chamber 26 comprises the electronic control of the device. This control is preferably formed by a micro-computer. For this purpose a commercially available computer may be employed, which is programmed for the purpose in view.

The deposition device according to the invention comprises a roller and a magnet arranged inside the same. The magnet may be multipolar and have a two-phase winding (see FIG. 2) or a three-phase winding (see FIG. 3). FIG. 2*b* illustrates the course of an electric field and its direction of rotation in the embodiment of FIG. 2*a*. The same applies to FIG. 2*d* with respect to FIG. 2*c*.

FIG. 3 shows two embodiments with a three-phase winding; FIG. 3*b* illustrates the field with the direction of rotation for the embodiment of FIG. 3*a* and FIG. 3*d* for the embodiment of FIG. 3*c*.

FIG. 4 shows a digital network 40, which may be formed by a micro-computer or a micro-processor. The micro-processor 40 forms digital signals, which are summed in weighted summation networks 41, 42, and 43, the outputs of said summation networks providing an electric signal as illustrated in FIG. 5. The filters 44, 45 and 46 will filter out the higher harmonics from the signal of FIG. 5 so that the windings 47, 48 and 49 are traversed by substantially sinusoidal currents having each time a given angular $\phi$ phase shift.

In the field shown charged toner particles will move with the field along the brush roller surrounding the electro-magnet. In this way the toner material can be transferred from a reservoir to the photo-conductive belt, whilst both the brush roller and the magnet are arranged stationarily.

What is claimed is:

1. A reproduction device of the electro-static type comprising an image carrier and a toner deposition device of the brush type consisting of a roller and a magnet arranged inside the same characterized in that the magnet and the roller are arranged so as to be stationary and the magnet is a multi-polar electro-magnet and has a three-phase winding, a generator forming digital signals and summation circuits for the weighted summation of said digital signals to produce respective alternating voltage output signals which are out of phase with respect to each other, the outputs of the summation circuits being each connected to a winding of the electro-magnet whereby a rotating magnetic field is produced by said electromagnet to cause toner particles to be moved around said roller, said three-phase winding being fed by a two phase current whereby a rotating magnetic field is produced by said electromagnet to cause toner particles to be moved around said roller.

2. A reproduction device of the electro-static type comprising an image carrier and a toner deposition device of the brush type consisting of a roller and a magnet arranged inside the same characterized in that the magnet and the roller are arranged so as to be stationary and the magnet is a multi-polar electro-magnet and has a three-phase winding, a generator forming digital signals and summation circuits for the weighted summation of said digital signals to produce respective alternating voltage output signals which are out of phase with respect to each other, the outputs of the summation circuits being each connected to a winding of the electro-magnet, said three-phase winding being fed by a three phase current whereby a rotating magnetic field is produced by said electromagnet to cause toner particles to be moved around said roller.

3. In an electrostatic reproduction device including a movable photo-sensitive member having a surface adapted to receive an image-producing charge, and brush-type toner depositing means cooperative with said surface to deposit toner particles thereon, the improvement wherein said depositing means comprises a toner reservoir, a stationary, hollow cylinder having an outer surface and positioned within the reservoir and with respect to said surface of the photo-sensitive member such that a portion of said outer surface extends from the toner particles contained within said reservoir to a depositing region in close adjacency with said surface of the photo-sensitive member, and stationary electromagnet means disposed within said cylinder, said electromagnet means comprising a circular pattern of magnetic pole members disposed along the inner circumference of said cylinder, at least two different sets of winding means associated with said pole members such that adjacent pole pieces are energized by different sets of said winding means, and energizing means for energizing said different sets of winding means respectively with alternating, out of phase electrical energy whereby said adjacent pole pieces reverse polarity in out of phase relation to cause toner particles to be transferred along said portion of the outer surface of the cylinder to said depositing region at a uniform rate which is dependent upon the frequency and amplitude of the alternating electrical energy.

4. A reproduction device of the electro-static type comprising an image carrier and a toner deposition device of the brush type consisting of a roller and a magnet arranged inside the same characterized in that the magnet and the roller are arranged so as to be stationary and the magnet is a multi-polar electro-magnet and has a three-phase winding, a generator forming digital signals and summation circuits for the weighted summation of said digital signals to produce respective alternating voltage output signals which are out of phase with respect to each other, the outputs of the summation circuits being each connected to a winding of the electro-magnet whereby a rotating magnetic field is produced by said electromagnet to cause toner particles to be moved around said roller.

5. A supply circuit as claimed in any one of claims 4, 1 or 2 characterized in that the generator is formed by a digital counter.

6. A supply circuit as claimed in any one of claims 4, 1 or 2 characterized in that the summation circuits are each connected through a filter circuit to the windings of the electro-magnet.

* * * * *